United States Patent [19]

Moussault

[11] 4,378,836

[45] Apr. 5, 1983

[54] MANIPULATION METHOD AND DEVICE FOR A FOUNDRY

[76] Inventor: Robert Moussault, 92, rue du Maréchal Joffre, 78380 Bougival, France

[21] Appl. No.: 193,941

[22] PCT Filed: Jun. 22, 1979

[86] PCT No.: PCT/FR79/00054

§ 371 Date: Feb. 22, 1980

§ 102(e) Date: Feb. 15, 1980

[87] PCT Pub. No.: WO80/00136

PCT Pub. Date: Feb. 7, 1980

[30] Foreign Application Priority Data

Jun. 22, 1978 [FR] France ..... 78 18729

[51] Int. Cl.[3] ..... B22D 41/12

[52] U.S. Cl. ..... 164/336; 164/136; 414/733

[58] Field of Search ..... 164/335, 336, 344, 345, 164/401, 404, 133, 136; 414/733, 687, 730, 706

[56] References Cited

U.S. PATENT DOCUMENTS

| | | | |
|---|---|---|---|
| Re. 28,437 | 6/1975 | Devol et al. | 414/733 X |
| 3,114,463 | 12/1963 | Fouron | 414/733 |
| 3,543,947 | 12/1970 | Devol | 414/733 |
| 3,845,284 | 10/1974 | Taguchi et al. | 414/733 X |

FOREIGN PATENT DOCUMENTS

| | | |
|---|---|---|
| 2022480 | 12/1971 | Fed. Rep. of Germany . |
| 1441612 | 6/1966 | France . |
| 1487894 | 7/1967 | France . |
| 2015611 | 4/1970 | France . |

*Primary Examiner*—Nicholas P. Godici
*Assistant Examiner*—K. Y. Lin
*Attorney, Agent, or Firm*—Lerner, David, Littenberg & Samuel

[57] ABSTRACT

A foundry manipulation method and device for foundry castings or equipment and in particular for molten metal, constituted by a frame 1 supporting an arm 9 to one of the ends of which there is fitted a member 11 for supporting castings, equipment or metal. According to the invention, the frame 1 comprises a fixed part 2 and a mobile part 3 rotating relative to part 2 about a vertical shaft. The support member 11 is hinged to end of the arm 9, arm is hinged in the vicinity of its other end **9*b* to the top of mobile part 3 about a horizontal pin 12 in such a manner that the support member 11 passes to a position directly above vertical shaft 3 during the movement of the arm 9 about its hinge 12, means 19** being provided to maintain support member in a vertical position, whatever the inclination of the arm.

9 Claims, 2 Drawing Figures

MANIPULATION METHOD AND DEVICE FOR A FOUNDRY

SCOPE OF THE INVENTION

The invention relates to a transfer and manipulation device for foundry accessories, and more precisely for a light alloy casting ladle.

PRIOR ART

In the foundry field, and in particular the light alloy foundry field, it is known to use what are currently called robots for carrying out the operations involved in manipulating castings, mould parts, cores or molten metal, from a first charging zone to a second discharge zone. They are thus used for example in order to withdraw such metal from one or more fixed molten metal holding furnaces using a ladle, transferring the full ladle to directly above one or more other stations in which moulds are prepared, by means of a device which automatically moves the ladle between the furnaces and moulds, pouring the metal into these moulds and returning the ladle to directly above a furnace in order to recommence this operation. Secondary stations can be provided about such robots for carrying out maintenance on the ladle or the manipulated elements, and the device is either automatically or manually controlled in bringing the ladle level with these stations.

Known devices for carrying out the manipulation movements are of various types. They are mainly mechanisms comprising bridges on which are horizontally moved the vertical mobile devices carrying the ladle, or arms hinged to rotate horizontally about a column and comprising at their free end a support or gripping member which can be driven with a vertical movement relative to the arm or column, if necessary accompanied by a traverse movement along the arm.

DESCRIPTION OF THE INVENTION

The present invention relates to a robot for manipulating foundry castings or equipment, and in particular molten metal for making castings, of the type in which the transfer operation is carried out by a support or gripping member carried at the end of an arm which can rotate in a vertical plane about a horizontal pin, said pin being carried by a part of a frame which rotates horizontally.

More particularly, it firstly provides a method for operating the arm in which, separately and consecutively, the arm is first elevated by rotation in said vertical plane until the support or gripping member is disposed directly over the vertical shaft of rotation of the rotating part of the frame, this part is then rotated horizontally about said vertical shaft, and finally the arm is made to continue its rotation in the same direction of rotation about its hinge in order to cause it to lower.

The invention secondly provides a manipulation device constituted by a frame supporting an arm, at one end of which there is attached a gripping or support member for the elements to be manipulated. The frame comprises a fixed part and a mobile part, rotatable relative to said fixed part about a vertical shaft. Said member is hinged to said end of the arm. Finally, said arm is hinged in the vicinity of its other end to the top of said mobile part, about a horizontal pin. Means for driving the arm about its hinge are disposed between said arm and said rotatable part of the frame in such a manner that the arm can be rotated through about 180°, the support or gripping member being able during its movement to describe substantially a vertical semicircle about the horizontal plane passing through said hinging pin. Means are provided for keeping said support member in a fixed position, for example vertical, in particular in the case of a casting ladle, whatever the inclination of the arm.

In a preferred embodiment, the means for driving the arm about its hinge are constituted by a cylinder rigid with the rotating part of the frame, its rod comprising a rack cooperating with a pinion rigid with the arm. The mobile part of the frame is rotated relative to the fixed part by a drive member of the cylinder type rigid with the fixed part, the rod of which comprises a rack cooperating with a drive pinion for the mobile part. It is advantageous if said arm is prolonged beyond its hinge relative to the support member, and has hinged to one of its ends the rod of a pneumatic compensating cylinder, itself hinged to the mobile part of the frame. Finally, a secondary arm hinged about said horizontal hinging pin and fitted at its end with proximity detection probes, extends along said arm.

The invention will be more apparent from the description given hereinafter by way of non-limiting example, which will enable the advantages and secondary characteristics to be deduced, and which is made with reference to the accompanying drawings.

Figure 1:
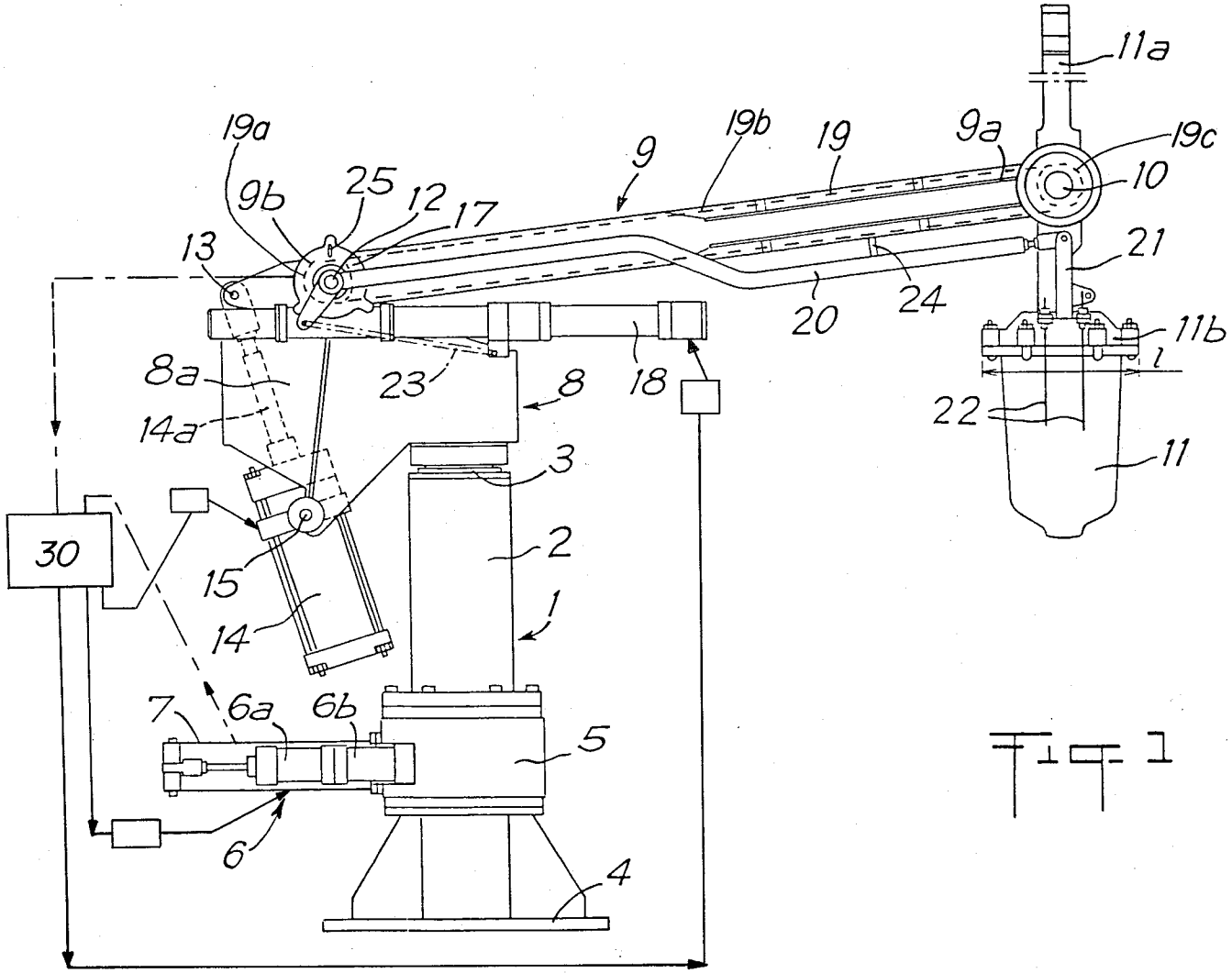
FIG. 1 is an elevation of a preferred embodiment of the device according to the invention, in its casting robot version.

These figures show a frame 1 comprising a fixed casing 2 embracing a vertical shaft 3. The casing is fixed to the ground by a bed-plate 4. At the level of a box 5, the vertical shaft 3 comprises an externally toothed wheel, not shown, which cooperates with a toothed rod, equally not shown, of a hydraulic device 6 of the cylinder or telescopic cylinder type. Two cylinders **6*a* and 6*b* are in fact shown here, fixed end to end, the rod of the cylinder 6*a* being fixed at its end to a support 7 rigid with the box 5, and thus with the casing 2, the rod of the cylinder 6*b* being toothed and forming a rack which cooperates with the toothed wheel rigid with the shaft 3**.

It can be seen that by feeding one and/or the other of the double acting cylinders, the vertical shaft 3 can be rotated in one direction or the other.

Figure 2:
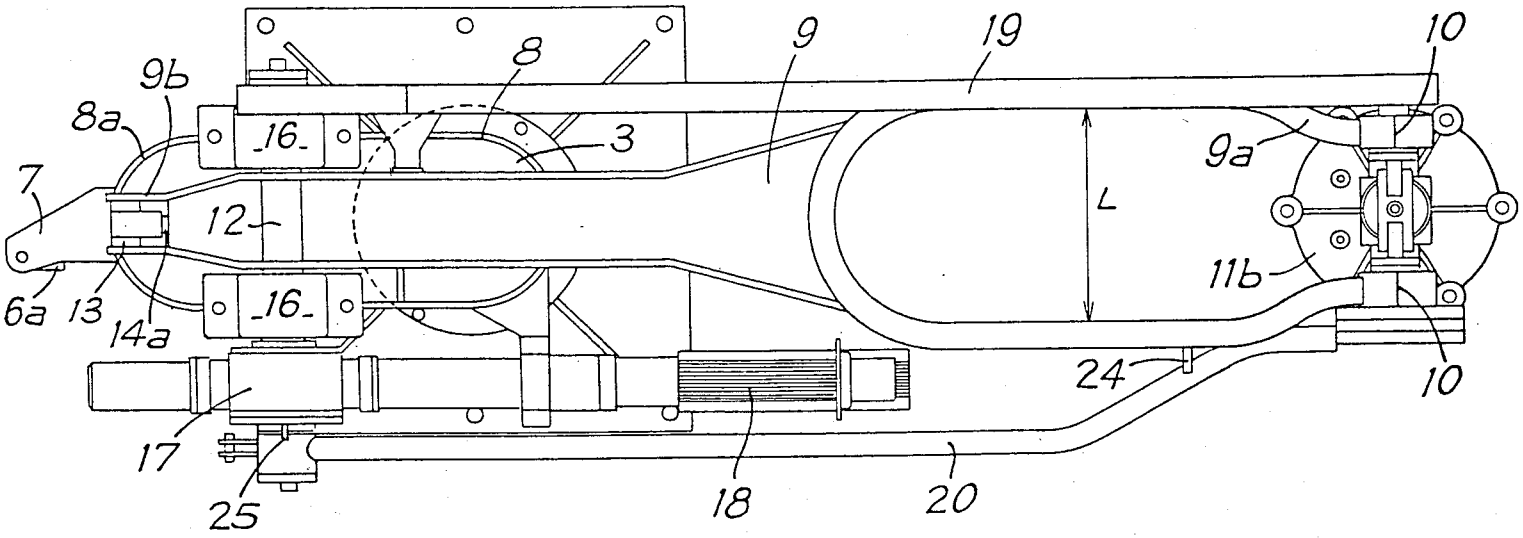
FIG. 2 is a plan view of FIG. 1.

At its top, the vertical shaft 3 is fitted with a part 8 having a hollow portion **8*a* offset relative to said shaft. The part 8 constitutes the fixing platform for the entire upper equipment of the device according to the invention. This equipment comprises an arm 9 having one end 9*a* in the form of a fork which carries a withdrawal ladle 11 hinged at 10. The maximum distance apart L (FIG. 2) of the two arms of the fork exceeds the maximum outer dimension 1 of the withdrawal ladle 11. This ladle is in particular a ladle with a stopper rod, the control mechanism for which is shown at 11*a*. An overpressure, a negative pressure or a neutral atmosphere can be provided in said ladle, which is closed by a cover 11*b***.

In the vicinity of its other end **9*b*, the arm 9 is hinged to the part 8 about a horizontal hinging pin 12. This pin is shown carried by the offset portion 8*a* of the part 8 for dimensional reasons and for simplifying the assembly. However, there is nothing to prevent disposing the pin 12 directly above the shaft 3, other than the fact that it would be necessary to provide a platform 8** of more complex shape to leave the clearances necessary for allowing the various movements of the hinged parts.

It can be seen from the figures that in this respect the end 9*b* of the arm 9 is extended beyond the hinging pin 12 relative to the ladle 11. This end constitutes a point at which the rod 14*a* of a pneumatic cylinder 14 is fixed by a hinge 13, its body being hinged at 15 to the two flanges which the portion 8*a* of the part 8 comprises at its bottom.

It should be noted that the pin 12 rotates rigidly with said arm 9, and is supported by bearings 16 rigid with the platform 8. In a casing 17, the pin 12 is fitted at one of its ends with a toothed wheel which cooperates with a rack. This rack is in fact constituted by the rod of a hydraulic cylinder 18, the body of which is fixed to the part 8. Thus when this cylinder is fed, it rotates the pin 12 and thus drives the arm 9 about its horizontal hinge on the part 8. The amplitude of the rotation can thus be at least 180°.

At the other end of the pin 12, the bearing 16 is fitted with a pinion 19*a* about which a chain 19*b* can pass. Said chain, which is endless, also passes about an identical pinion 19*c* provided at the end of the hinging pin 10 of the ladle—with which it is rigid—at the arm end 9*a*. This chain and its two pinions are shown in phantom in the figure as they are enclosed in a protection casing 19. Thus, as the arm 9 rotates with its pin 12 held in the chain, the chain winds about the fixed pinion and causes the pinion rigid with the pin 10 to turn through an angle equal to the angle of inclination through which the arm has travelled, so that the ladle 11 preserves its initial orientation, i.e. its verticality.

Finally, a second arm 20 is provided along the arm 9. This latter is mounted so that it rotates about the pin 12 by means of one of its ends, while its other end carries a support 21 for probes 22 which detect the level of the bath in the furnace. This secondary arm is urged by a spring 23 against a stop 24 rigid with the arm 9. However, a fixed stop 25 provided on a member rigid with the piece 9 (in this case the casing 17) retains said arm 20 in a substantially vertical position so that it does not follow the rotation of the arm 9 beyond this position in order not to obstruct the casting zone.

The operation of the robot described heretofore is as follows. It will be firstly assumed that in the position shown in FIG. 1 the casting ladle 11 is plunged into the furnace for withdrawing metal. After closing the ladle by means of its stopper rod, and possibly putting the ladle under vacuum by means of the control mechanism 11*a* and a control device 30 the arm 9 is raised by means of the cylinder 18 and cylinder 14.

The effect of the pneumatic pressure applied to the cylinder 14 is to retract the rod 14*a* to provide a torque which is added to the lifting torque applied by the hydraulic cylinder 18. The ladle 11 preserves its vertical position during this lifting by virtue of the chain enclosed in the casing 19. The ladle thus arrives directly over the shaft 3. At this moment, its movement is halted by an arm position detector, not shown, and the hydraulic cylinder mechanism 6 is fed in order to rotate the shaft 3 through a predetermined amount. The feed for these cylinders is preset on a known control device for the angular indexing of the robot. It should be noted that by carrying out this indexing operation when the casting ladle is directly above the vertical shaft 3, there is the advantage on the one hand of eliminating the effect of the centrifugal force exerted on the liquid in the ladle and thus preventing any swirling which could lead to the inclusion of impurities in the molten metal, and on the other hand of substantially reducing the energy necessary for carrying out this indexing, because in this configuration the robot has a minimum moment of inertia about the shaft 3.

When the indexing operation has been carried out, the rotation of the arm 9 is caused to continue, by means of the cylinder 18 and cylinder 14, until the hinge 13 is aligned with the hinges 12 and 15. Beyond this, the arm 9 either begins its descent if the hinges 12 and 15 are on a vertical line, or it terminates its elevation to be followed by a lowering movement if the hinge 15 is displaced to the left, in FIG. 1, of the vertical passing through the hinge 12, and is driven only by the cylinder 18 as the cylinder 14 then operates as a brake for said descent. In this respect, said cylinder 14 is always fed in the sense of retracting its rod 14*a*. Such an arrangement advantageously compensates the increase in the torque applied to the arm 9 during its descent, due to the weight. During this time, the ladle 11 passes between the two branches of the end 9*a* of the arm, which are sufficiently spaced apart to allow this passage. In this respect, an arm in the form of a single beam could be provided by laterally offsetting at least part of its length relative to the hinge 10 and hinge 12, to allow lateral passage of the ladle 11. When the arm has arrived above the mould, the feed to the cylinder 14 is reversed, to create a force for positioning the ladle 11 on the mould casting mouth. Casting is controlled by opening the ladle using its stopper rod, and when casting is terminated, the feeds to the cylinder 14 and cylinder 18 are again reversed to return the empty ladle 11 directly over the shaft 3. A new angular indexing operation is then carried out by means of the cylinders 6*a* and 6*b*. This indexing can be different from the initial one if in the vicinity of the robot there has been provided a second furnace from which the metal can be ladled, or a maintenance station for the ladle. The arm is then made to descend again, with the cylinder 14 again performing its braking function.

It should be noted that the role of the cylinder 14 can be varied by varying the pressure which it receives during its operation, so that it performs either a compensation function or maintains the ladle on the mould.

During the raising of the arm 9 with the ladle full, the secondary arm 20 accompanies it by the effect of the spring 23. As it approaches the vertical, the arm 20 is retained by the stop 25 so that it does not obstruct the positioning of the ladle on the mould. On its return, the secondary arm 20 is lowered by the stop 24 during the descent of the arm 9, so that the probes 22 become disposed in their active position. These in effect govern the plunging of the ladle into the bath.

It can therefore be seen that the invention makes use of simple means for constructing a robot of great strength. Moreover, the looping transfer of the casting ladle frees the floor areas and working stations situated around the robot, while increasing reliability. Finally, by its design, the energy necessary for its operation is reduced, and the times for the operations can advantageously be shortened.

POSSIBLE INDUSTRIAL APPLICATIONS

The invention finds important application in the foundry field.

It is not limited to the description given, but instead covers all modifications which can be made to it without leaving the scope of the inventive idea. Thus, instead of a hinged ladle, the arm 9 can be fitted with a support member hinged at 10 to its end 9*a* for receiving cores, moulds, castings withdrawn from moulds etc.

In this respect, the robot is nothing other than a device for manipulating foundry accessories from one or more charging positions to one or more discharge positions disposed within or to the side of said furnaces or moulds.

Thus, for example, an installation could be imagined comprising two robots, the first being used between a furnace and the pouring into moulds moving on one or more conveyors passing in its vicinity, and the second robot being used to manipulate castings withdrawn from the moulds between said conveyors and one or more conveyors for removing said castings, the moulds being returned in the direction of the first robot.

I claim:

1. A transfer device comprising a frame including a fixed part and a mobile part rotatable relative to said fixed part about a vertical shaft, an arm hinged at one end thereof to the top of said mobile part about a horizontal pin and provided at its other end with means for attaching a load, means for rotating the mobile part of the frame relative to its fixed part, means for driving the arm about said horizontal pin, said driving means arranged between the mobile part of the frame and said arm in such a manner that the arm can rotate through approximately 180° and wherein said arm is arranged such that the attachment means is driven along a substantially vertical semicircle above a horizontal plane passing through said horizontal pin and said vertical semicircle including the axis of said vertical shaft, and means for controlling said rotating means, said control means being operative when said attachment means is directly above the axis of said vertical shaft.

2. A device as claimed in claim 1, wherein said driving means comprises a cylinder rigid with the mobile part, said cylinder having a rod of rack configuration cooperating with a pinion rigid with the arm.

3. A device as claimed in claim 2, wherein along said arm, a secondary arm is hinged about said horizontal pin and is provided at its end with proximity detection probes.

4. A device as claimed in claim 3, wherein said secondary arm is biased against a stop by a spring member in a substantially vertical position, said first mentioned arm being capable to drive said secondary arm against the bias of said spring member.

5. A device as claimed in claim 3, wherein said proximity probes are adapted for detecting the level of a bath in a furnace.

6. A device as claimed in claim 1, wherein said one end of said arm extends beyond said horizontal pin relative to the frame and is hinged to a rod of a pneumatic compensating cylinder, said cylinder being hinged to the mobile part of the frame.

7. A device as claimed in claim 6, wherein said cylinder is operative such that said rod is retractable, thereby comprising auxiliary drive means for raising said arm and means for braking said arm when said arm lowers.

8. A device as claimed in claim 7 adapted for withdrawing, transferring and pouring a molten metal, wherein said attachment means is a casting ladle, and wherein said pneumatic cylinder is operated at the moment of pouring in the direction of extraction of the rod to maintain the casting ladle on the mould.

9. A device as claimed in claim 8 further including means for maintaining the orientation of the casting ladle vertical, said maintaining means comprising an endless chain disposed between a first pinion coaxial with said horizontal pin of the arm and rigid with the mobile part of the frame, and a second pinion coaxial with a hinge of said ladle on the arm and rigid with said ladle.

* * * * *